US005207130A

United States Patent [19]

Payne

[11] Patent Number: 5,207,130

[45] Date of Patent: May 4, 1993

[54] RATCHET LOCKING PLIER

[76] Inventor: Jerry A. Payne, Rte. 1, Box 384AA, Ripley, W. Va. 25271

[21] Appl. No.: 853,833

[22] Filed: Mar. 19, 1992

[51] Int. Cl.[5] ..... B25B 13/32

[52] U.S. Cl. ..... 81/90.2; 81/112; 279/50

[58] Field of Search ..... 81/300, 318-325, 81/328, 361, 58.1, 58, 90.2-90.9, 91.3, 112-114, 180.1, 185, 185.1, 185.2, 128; 279/50, 51

[56] References Cited

U.S. PATENT DOCUMENTS 3,377,893 4/1968 Shorb ..... 81/113

4,235,134 11/1980 McLendon ..... 81/90.2

*Primary Examiner*—D. S. Meislin

*Attorney, Agent, or Firm*—S. Michael Bender

[57] ABSTRACT

A ratchet wrench includes an expandible fastener engaging socket which may be positioned over a conventional fastener and which may then be decreased in diameter to effect a gripping attachment. A locking lever is attached to the ratchet wrench and is usable to both decrease the diameter of the expandable socket and to lock the socket in attachment with the fastener. The lever operates in the manner of a conventional lockable plier so as to provide the ratchet socket wrench with a plier-like function.

5 Claims, 6 Drawing Sheets

RATCHET LOCKING PLIER

BACKGROUND OF THE INVENTION

1. Field of the Invention

The present invention relates to socket wrenches and more particularly pertains to a socket wrench which utilizes an adjustable size socket and locking mechanism.

2. Description of the Prior Art

The use of both ratchet socket wrenches and locking pliers is known in the prior art. For example, U.S. Pat. No. Des.265,962 which issued to O. Izumisawa on Aug. 31, 1982 discloses a ratchet type socket wrench which is very representative of the prior art and which discloses the fact that such wrenches are utilizable with fastener engaging sockets that are not adjustable in size and which cannot be locked in engagement with a fastener.

U.S. Pat. No. 3,793,914, which issued to H. Helms on Feb. 26, 1974, discloses locking pliers of a conventional design wherein such pliers can be adjustably positioned around a fastener in locked engagement therewith which overcomes this lack of capability in a ratchet type socket wrench. However, no ratcheting function is then provided as is available with the socket wrench so that a trade off must be made by a user between adjustable fastener engaging size or a ratcheting capability.

As such, there would appear to be some interest in developing a ratchet type socket wrench which might have a locking plier capability and in this respect, the present invention substantially fulfills this interest.

SUMMARY OF THE INVENTION

In view of the foregoing disadvantages inherent in the known types of ratchet type socket wrenches and locking pliers now present in the prior art, the present invention provides an improved wrench and plier construction wherein a ratchet type socket wrench is provided with a locking plier capability. As such, the general purpose of the present invention, which will be described subsequently in greater detail, is to provide a new and improved ratchet vise wrench which has all the advantages of the prior art ratchet type socket wrenches and locking pliers and none of the disadvantages.

To attain this, the present invention essentially comprises a ratchet wrench which includes an expandible fastener engaging socket which may be positioned over a fastener and which may then be decreased in diameter to effect a gripping attachment. A locking lever is attached to the ratchet wrench and is usable to both decrease the diameter of the expandable socket and to lock the socket in attachment with the fastener. The lever operates in the manner of a conventional locking plier so as to provide the ratchet socket wrench with a plier-like function.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ratchet locking plier which has all the advantages of the prior art ratchet locking pliers and none of the disadvantages.

It is another object of the present invention to provide a new and improved ratchet locking plier which may be easily and efficiently manufactured and marketed.

It is a further object of the present invention to provide a new and improved ratchet locking plier which is of a durable and reliable construction.

An even further object of the present invention is to provide a new and improved ratchet locking plier which is susceptible of a low cost of manufacture with regard to both materials and labor, and which accordingly is then susceptible of low prices of sale to the consuming public, thereby making such ratchet locking pliers economically available to the buying public.

Still yet another object of the present invention is to provide a new and improved ratchet locking plier grip which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
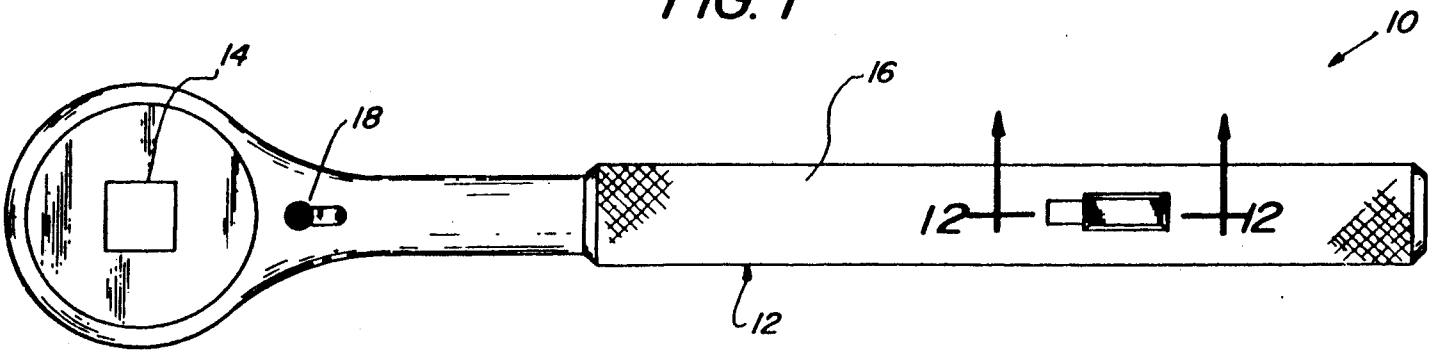
FIG. 1 is a top plan view of the ratchet locking plier comprising the present invention.
Figure 2:
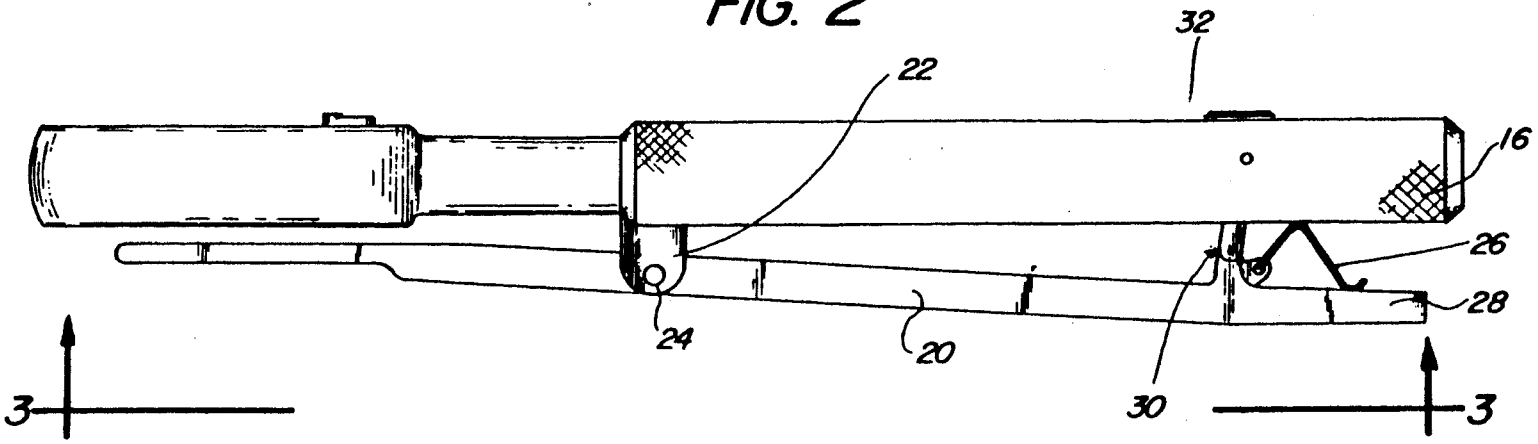
FIG. 2 is a side elevation view of the invention.
Figure 3:
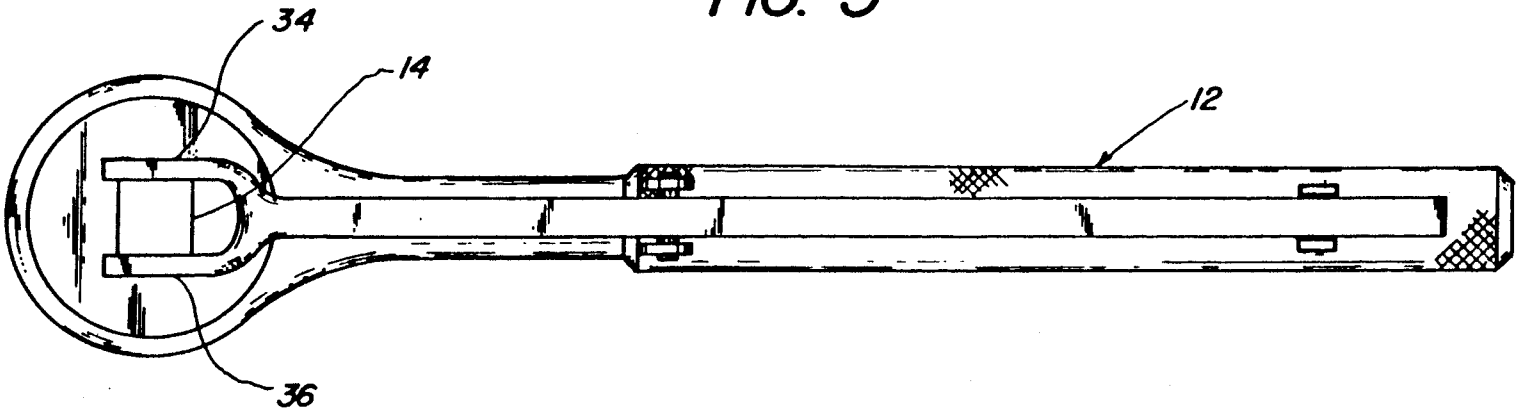
FIG. 3 is a bottom plan view of the invention as viewed along the line 3—3 in FIG. 2.

With reference now to the drawings, and in particular to FIGS. 1-3 thereof, a new and improved ratchet locking plier embodying the principles and concepts of the present invention and generally designated by the reference numeral 10 will be described.

In this regard, it can be seen that the ratchet locking plier 10 includes a ratchet type socket wrench 12 which may be of a conventional construction with respect to its ratcheting mechanism and which is designed to receive a fastener engaging socket in a square-shaped aperture 14 also in a conventional manner. The wrench 12 includes a conventional knurled handle 16 and a selection button 18 which may be utilized to operate a conventional ratcheting mechanism in either a clockwise or counter-clockwise direction.

Attached to the ratchet type socket wrench 12 is a pivotally movable lever 20 which functions as the operating mechanism for controlling the size of an expandible fastener engaging socket to be described subsequently in greater detail. The lever 20 is pivotally attached to a fulcrum arm 22 by means of a conventional bearing pin 24. A flexible spring 26 is pivotally attached to the lever 20 and is positionable between a bottom end 28 of the lever and a bottom portion of the handle 16. The spring 26 operates to keep the lever 20 in a desired location whether or not the wrench 10 is being utilized. Additionally, a locking mechanism 30 is pivotally attached to the lever 20 and extends into the handle 16, with a locking mechanism release button 32 being positioned on an opposed side of the handle. The operation of the locking mechanism 30 will be described subsequently in this specification. The remaining free end of the lever 20 is of a bifurcated construction and includes first and second parallelly-aligned arms 34,36. As best illustrated in FIG. 3, the arms 34,36 are aligned with the aperture 14 for a purpose which will be described subsequently in greater detail.

Figure 6:
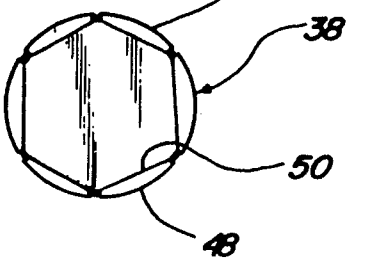
FIG. 6 is a bottom plan view of the expandible socket.
Figure 5:
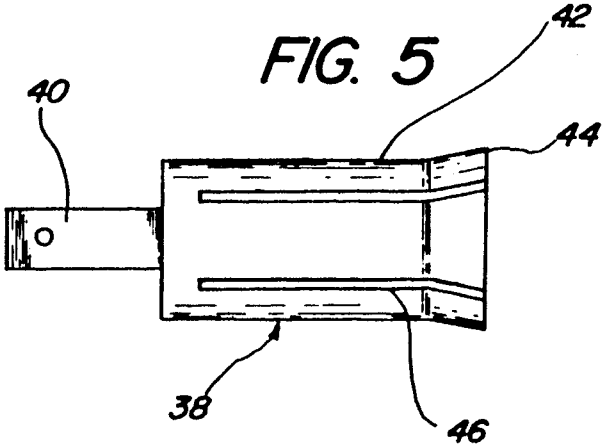
FIG. 5 is a side elevation view of the expandible socket.
Figure 4:
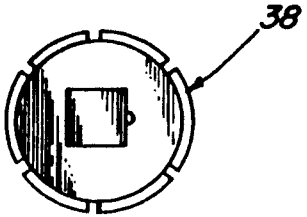
FIG. 4 is a top plan view of the expandible socket forming a part of the present invention.
Figure 9:
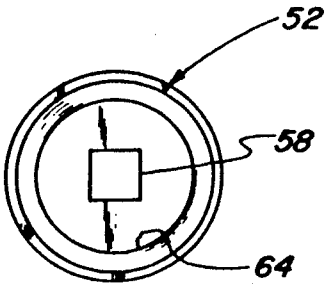
FIG. 9 is a bottom plan view of the collet.
Figure 8:
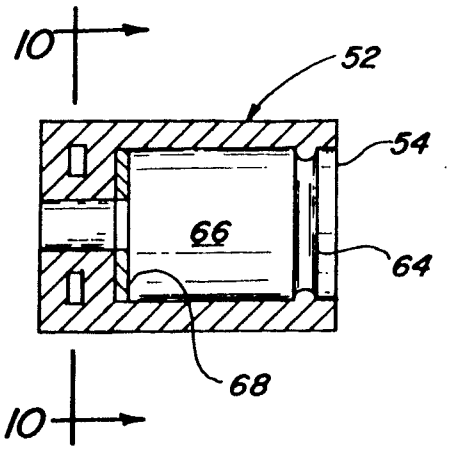
FIG. 8 a cross-sectional view of the collet as viewed along the line 8—8 in FIG. 7.
Figure 10:
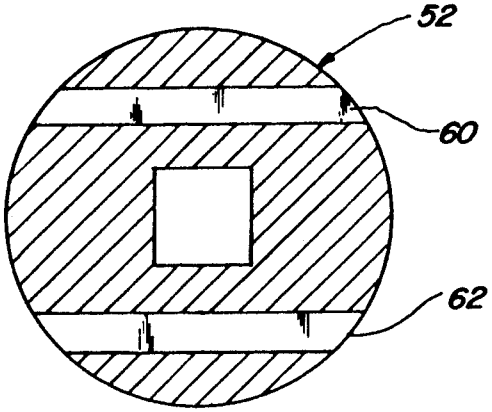
FIG. 10 is a cross-sectional view of the collet as viewed along the line 10—10 in FIG. 8.
Figure 7:
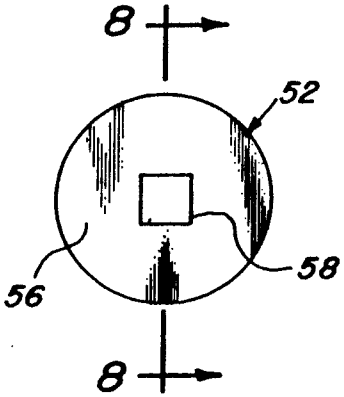
FIG. 7 is a top plan view of the socket control collet forming a part of the present invention.

FIGS. 4-6 illustrate the construction of the expandible socket 38 forming a part of the present invention. As shown, the socket 38 is somewhat similar in design to a conventional socket inasmuch as it has a wrench engaging arm 40 which is of an extended length, square construction and which is lockable within the aperture 14 on the wrench 12. The fastener engaging socket head 42 is of an elongated tubular construction and is integrally connected to the wrench engaging arm 40. The socket head 42 includes a flared free end 44 and a plurality of longitudinally extending slots, all of which are designated by the reference numeral 46.

While the socket head 42 is of a cylindrical design, it can be seen with reference to FIG. 6 that the longitudinal slots 46 effectively causes the socket head 42 to define a plurality of longitudinally extending, parallel-aligned fingers, all of which are generally designated by the reference numeral 48. Each finger 48 has a curvilinear exterior surface and a flat planar interior surface 50. As can be seen in FIG. 6, there are six fingers 48 in a socket head 42 whereby a hexagonal interior surface is defined so that the socket head can be positioned over a conventional fastener such as a six-sided nut, bolthead, or the like.

FIGS. 7-10 illustrate the socket control collet 52 which also forms a part of the present invention. The socket control collet 52 is of a cylindrical design having an open end 54 and a closed end 56 with a square-shaped aperture 58 being directed through a central portion of the closed end. Additionally, the collet 52 has two through-extending rectangularly-shaped apertures 60,62, with these apertures being designed to receive the arms 34,36 associated with the lever 20. The open end 54 of the collet 52 includes an interior integral lip 64 which circumscribes the interior cavity 66 of the collet, and a rubber cushioning washer 68 is positioned on a bottom portion of the cavity.

Figure 11:
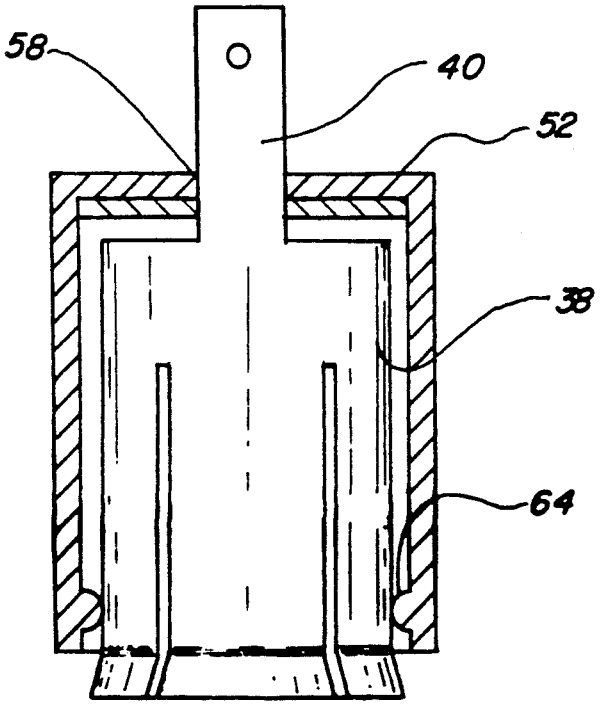
FIG. 11 is a side elevation view, partly in cross-section, showing the collet and expandible socket mounted together in a working relationship.

FIG. 11 of the drawings illustrates the collet 52 positioned over an expandible socket 38. In this regard, the arm 40 associated with the expandible socket 38 is positionable through the aperture 58 formed in the collet 52 with the integral interior lip 64 then engaging the external cylindrical sidewall of the socket 38.

Figure 12:
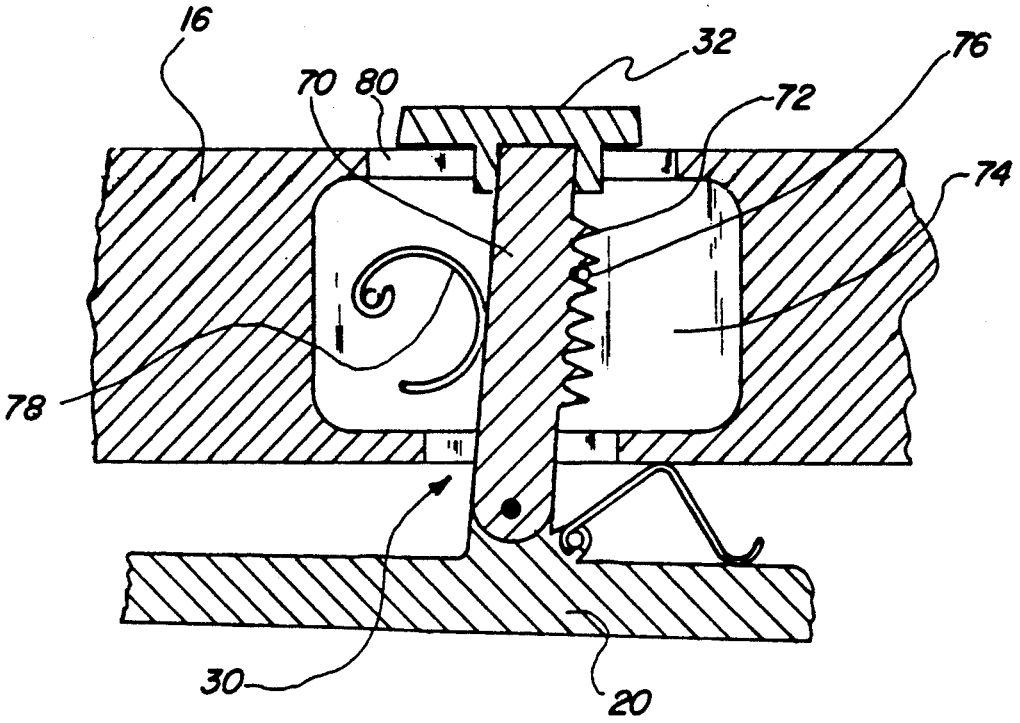
FIG. 12 is a cross-sectional view of the locking mechanism associated with the invention as viewed along the line 12—12 in FIG. 1.

FIG. 12 of the drawings has been provided to illustrate the operation of the locking mechanism 30 as originally mentioned with reference to FIG. 2. As can be seen, the mechanism 30 includes an arm 70 which is pivotally attached to the lever 20 and which includes a plurality of pin engaging teeth 72 integrally formed thereon. The arm 70 is directed through a through-extending cavity 74 formed in the handle 16, with the teeth 72 being engageable with a pin 76 extending through the handle and directed orthogonally with respect to the arm 70. An interiorly mounted spring 78 controls the positioning of the arm 70 so as to normally maintain it in engagement with the pin 76, thereby locking the positioning of the lever 20. The button 32 is slidable within a slot 80 formed on the handle 16 and operates to move the arm 70 forwardly towards the socket head, thereby to bring the teeth 72 out of engagement with the pin 76 whereby the lever 20 may be pivoted around its pivot point 24. Once a desired positioning of the lever 20 has been achieved, a release of the button 32 will allow the springs 78 to move the arm 70 back into engagement with the pin 76 wherein the lever 20 is again locked in position.

Figure 13:
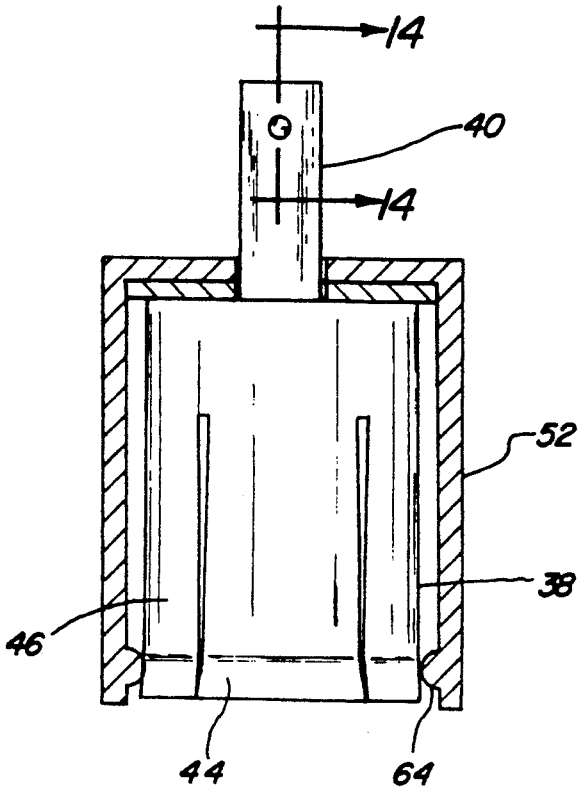
FIG. 13 is a side elevation view, partly in cross-section, illustrating the combined operation of the collet and expandible socket.
Figure 14:
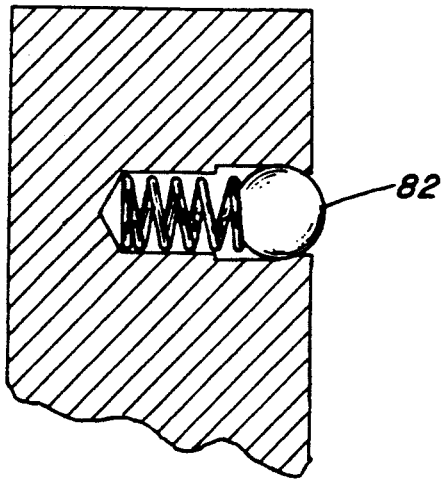
FIG. 14 is a cross-sectional view of the expandible socket as viewed along the line 14—14 in FIG. 13.
Figure 15:
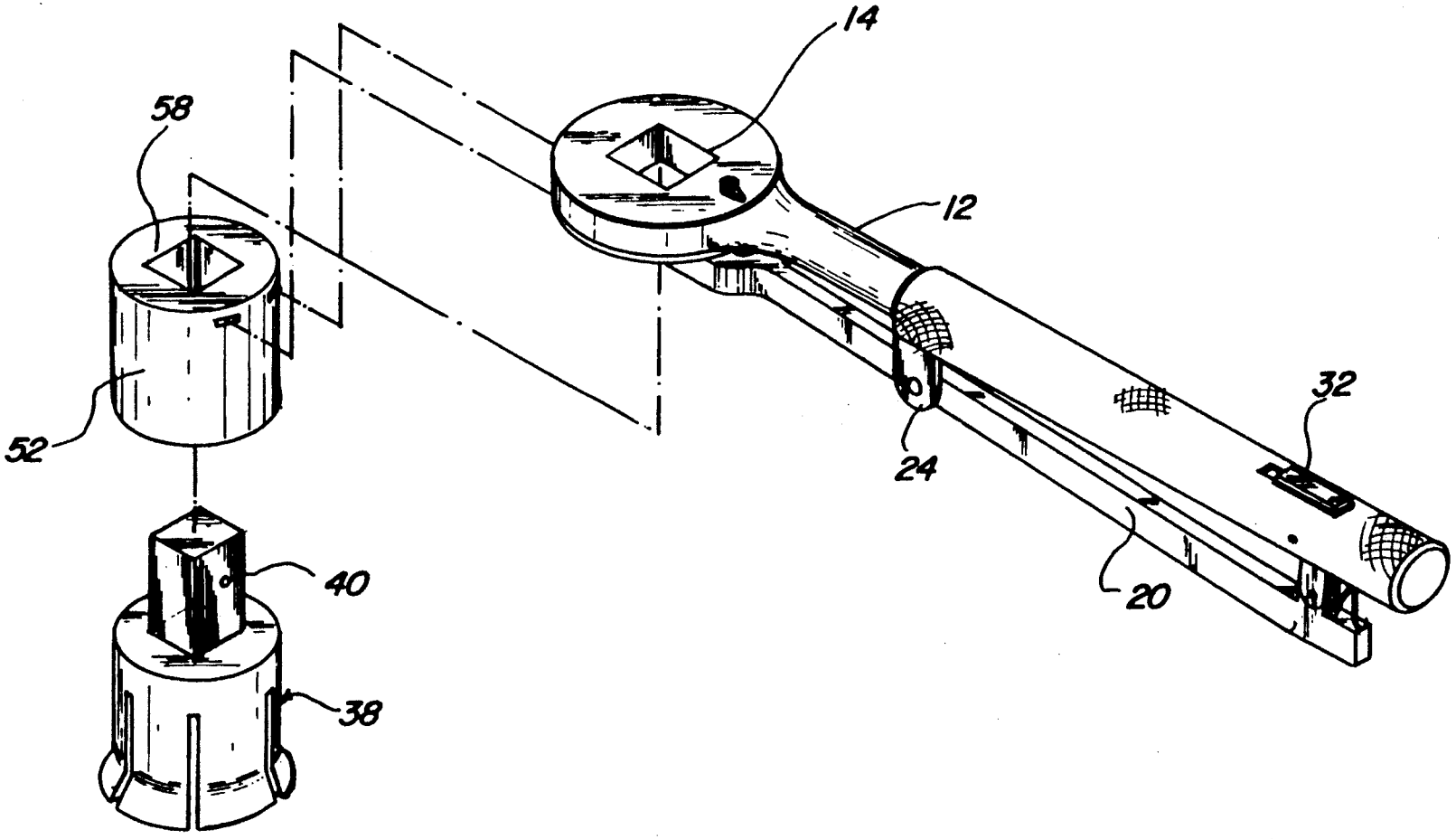
FIG. 15 is an exploded perspective view of the invention showing all of its operable parts.

The overall use of the invention 10 will be understood with reference to FIGS. 13–15. As can be seen, the arm 40 associated with the expandable socket 38 is directed through the aperture 58 formed in the socket control collet 52 and then onwardly through the square-shaped aperture 14 formed in the wrench 12. A conventional spring-loaded locking ball 82 is mounted in the arm 40 and serves to keep the arm positioned through the aperture 14 in a conventional manner. Prior to directing the arm 40 through the apertures 58 and 14, the socket control collet 52 is attached to the lever 20 by having the forked arms 34,36 positioned within the apertures 60,62 respectively formed on the collet. These arms 34,36 serve to hold the collet in position against the wrench head so that the arm 40 can be directed through the respective apertures 58,14 and locked relative thereto.

The expandible socket head 44 can then be positioned over a hexagonally shaped fastener and by sliding the button 32 forwardly towards the wrench head, the lever 20 is unlocked whereby it may be pivoted around the pin 24. By such pivotal movement, the socket control collet 52 moves downwardly over the expandible socket 38 whereby the lip 64 engages the flared end 44 of the socket to thus force all of the fingers 46 towards one another. This of course results in each of the planar surfaces 50 coming into engagement with a side of the fastener over which the socket 38 has been positioned, thereby to effect a frictional and tight engagement therewith. Once such a type engagement has been achieved, the button 32 may be allowed to slide rearwardly down the handle 16 so as to again engage the locking mechanism 30 and fixedly secure the lever 20 against any further movement. As such, a locking plier like action has been achieved to effectively lock the socket 38 around a fastener so that the wrench can be utilized to release or tighten a fastener in a conventional manner. A reverse positioning of a conventional socket can be achieved by putting such conventional socket within the aperture 14 from the opposed side whereby the ratcheting mechanism associated with the wrench 12 can be used.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved ratchet locking plier comprising:

ratchet wrench means;

expandable socket means operably attachable and usable with said ratchet wrench means; and collet means for effecting an attachment of said expandable socket means to a fastener; said ratchet locking plier further including lever means pivotally attached to said ratchet wrench means, said lever means being operable to move said collet means into operable engagement with said expandable socket means, thereby to cause said expandable socket means to attach to said fastener.

2. The new and improved ratchet locking plier as described in claim 1, wherein said lever means is provided with locking means, thereby to effectively cause said collet means to stay in operable engagement with said expandible socket means.

3. The new and improved ratchet locking plier as described in claim 2, wherein said lever means is of a bifurcated construction and is engageable with said collet means by having bifurcations associated with said lever means positioned within a pair of apertures formed in said collet means.

4. A wrenching apparatus for fasteners comprising:

wrenching means for applying a torque to a fastener about a first predetermined axis extending perpendicular to the longitudinal axis of said wrenching means, socket means associated with said wrenching means, said socket means and said wrenching means being rotatable about said predetermined axis, said socket means having radially adjustable gripping means for fitting fasteners of differing size, collet means operatively positionable between said wrenching means and said socket means and slidable with respect to said socket means along said predetermined axis for causing radial adjustment of said socket means, and drive means on said wrenching means operable for causing relative slidable movement between said socket means and said collet means along said predetermined axis and said drive means engaging said collet means and being movable along said predetermined axis relative to both said wrenching means and said socket means.

5. The wrenching apparatus of claim 4 wherein said radially adjustable means on said socket means comprises a plurality of longitudinally extending, parallel-aligned fingers each of which comprises a curvilinear outer radial surface with respect to said predetermined axis and a substantially flat inner radial surface with respect to said predetermined axis.

* * * * *